US009778594B2

(12) United States Patent
Tenjiku

(10) Patent No.: US 9,778,594 B2
(45) Date of Patent: Oct. 3, 2017

(54) DEVELOPING DEVICE

(71) Applicant: Sharp Kabushiki Kaisha, Osaka (JP)

(72) Inventor: Eiji Tenjiku, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/280,667

(22) Filed: Sep. 29, 2016

(65) Prior Publication Data

US 2017/0102636 A1 Apr. 13, 2017

(30) Foreign Application Priority Data

Oct. 8, 2015 (JP) ..... 2015-200214
Aug. 9, 2016 (JP) ..... 2016-156364

(51) Int. Cl.
*G03G 15/09* (2006.01)
*G03G 15/08* (2006.01)

(52) U.S. Cl.
CPC ..... *G03G 15/0812* (2013.01); *G03G 15/0921* (2013.01)

(58) Field of Classification Search
USPC ..... 399/119, 252, 265–267, 272–277, 281, 399/282
See application file for complete search history.

(56) References Cited

U.S. PATENT DOCUMENTS 7,577,388 B2 * 8/2009 Matsumoto ..... G03G 15/09 399/277
8,331,834 B2 * 12/2012 Koetsuka ..... G03G 15/0921 399/111
8,422,909 B2 * 4/2013 Kabashima ..... G03G 15/0921 399/104

FOREIGN PATENT DOCUMENTS

JP 2013-200547 A 10/2013

* cited by examiner

*Primary Examiner* — Hoan Tran
(74) *Attorney, Agent, or Firm* — Renner Otto Boisselle & Sklar, LLP

(57) ABSTRACT

A developing device includes: a developing roller that rotates in a given rotation direction; and a regulating portion that regulates the amount of feed of developer. The developing roller includes a circumferential surface on which a regulating pole having single polarity is formed. At the regulating pole, a magnetic flux density in a direction normal to the circumferential surface of the developing roller takes a maximum in a first position on the circumferential surface in the rotation direction and takes a value half of the maximum in a second position and a third position on the circumferential surface in the rotation direction. The first position is shifted downstream from a intermediate position between the second and third positions. A tip portion of the regulating portion faces a position between the first position and the intermediate position or faces the first position.

10 Claims, 5 Drawing Sheets

DEVELOPING DEVICE

CROSS REFERENCE

This Nonprovisional application claims priority under 35 U.S.C. §119(a) on Patent Application No. 2015-200214 filed in Japan on Oct. 8, 2015, and Patent Application No. 2016-156364 filed in Japan on Aug. 3, 2016, each of the entire contents of which are hereby incorporated by reference.

BACKGROUND OF THE INVENTION

1. Field of the Invention

This invention relates to a developing device, more specifically, to a developing device employed in an image forming apparatus of an electrophotographic system.

2. Description of Related Art

In an image forming apparatus of an electrophotographic system, an electrostatic latent image formed on a photoreceptor drum is developed by a developing device. In many cases, a two-component developer containing nonmagnetic toner and magnetic carrier is used as developer required for the development (see Japanese published unexamined patent application No. 2013-200547, for example). In the developing device, the developer is lifted from a developer bath to a developing roller and the developer is fed to a developing position by the rotation of the developing roller. In the developing device, to regulate the amount of feed of the developer, a regulating portion is provided upstream from the developing position in a rotation direction of the developing roller. Specifically, the regulating portion is to scrape off a redundant portion of the developer from a circumferential surface of the developing roller so as to feed the developer at a constant amount.

In the aforementioned developing device, however, conveying the developer into the regulating portion causes stress on the developer. This stress has been a cause for increase in a torque required for the rotation of the developing roller. In particular, using low-temperature fixing toner as the nonmagnetic toner in the developer has caused a problem of increasing the torque required for the rotation of the developing roller to such a degree that it becomes difficult to drive the developing device continuously.

SUMMARY OF THE INVENTION

A developing device of this invention includes a developing roller and a regulating portion. The developing roller rotates in a given rotation direction to feed developer containing nonmagnetic toner and magnetic carrier to a developing position. The developing roller includes a circumferential surface on which a regulating pole having single polarity is formed. The regulating portion regulates the amount of feed of the developer in a position upstream from the developing position in the rotation direction and adjacent to the circumferential surface of the developing roller. At the regulating pole, a magnetic flux density in a direction normal to the circumferential surface of the developing roller takes a maximum in a first position on the circumferential surface in the rotation direction and takes a value half of the maximum in a second position and a third position on the circumferential surface in the rotation direction. The first position is shifted downstream from a intermediate position between the second and third positions. A tip portion of the regulating portion faces a position between the first position and the intermediate position or faces the first position.

DETAILED DESCRIPTION OF THE EMBODIMENTS

Figure 1:
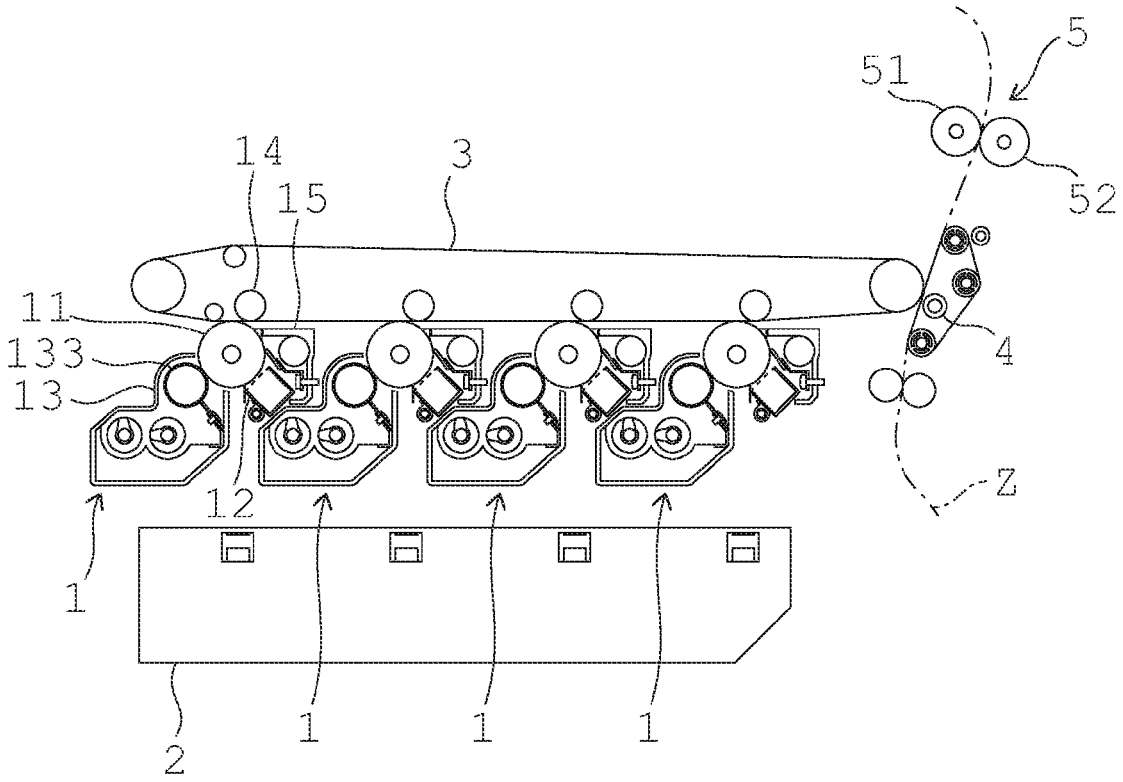
FIG. 1 is a conceptual view showing a principal section of an image forming apparatus in which a developing device of this invention is employed.

An embodiment where a developing device of this invention is employed in an image forming apparatus will be described below by referring to the drawings.

[1] Structure of Image Forming Apparatus

As shown in FIG. 1, the image forming apparatus prints an image on a sheet Z by performing image forming processing of an electrophotographic system based on image data. More specifically, the image forming apparatus includes four main processors 1, an exposure device 2, an intermediate transfer belt 3, a secondary transfer roller 4, and a fixing device 5 that form a principal section of the image forming apparatus. The image forming apparatus of this embodiment employs CMYK space as color space. The four main processors 1 are to generate toner images of the four colors (cyan, magenta, yellow, and black) forming the CMYK space respectively. The number of the main processors 1 may be changed in a manner that depends on color space to be employed. For example, an image forming apparatus for monochrome printing includes one main processor 1.

Each of the main processors 1 includes a photoreceptor drum 11, a charging device 12, a developing device 13, a primary transfer roller 14, and a cleaning device 15. The photoreceptor drum 11 is an electrostatic latent image bearing member. The charging device 12 charges the photoreceptor drum 11 in such a manner that the circumferential surface of the photoreceptor drum 11 is placed at a given potential. In response to irradiation with laser from the exposure device 2, an electrostatic latent image responsive to image data is formed on the circumferential surface of the charged photoreceptor drum 11.

The developing device 13 applies a bias (developing bias) to a developing roller 133, thereby moving toner adhering to the circumferential surface of the developing roller 133 to the circumferential surface of the photoreceptor drum 11 in a developing position. In this way, the electrostatic latent image is developed into a toner image. In this embodiment, developer containing nonmagnetic toner and magnetic carrier is used and the nonmagnetic toner in the developer is used for the development of the electrostatic latent image. In response to the rotation of the photoreceptor drum 11, the toner image is carried to a position where the toner image is to be transferred onto the intermediate transfer belt 3 (primary transfer). The structure of the developing device 13 will be described in detail later.

The primary transfer roller 14 transfers the toner image born on the photoreceptor drum 11 onto the intermediate transfer belt 3. More specifically, in response to application of a bias to the primary transfer roller 14, the primary transfer roller 14 generates electrostatic force in the toner forming the toner image and moves the toner image to the intermediate transfer belt 3 using the electrostatic force.

Toner images in the four colors generated by the four main processors 1 based on the image data are transferred to the same region on the intermediate transfer belt 3 so as not to shift from each other. In this way, the toner images in the four colors overlap each other to form a full-color toner image on the intermediate transfer belt 3. In response to the rotation of the intermediate transfer belt 3, the full-color toner image is carried to a position where the full-color toner image is to be transferred onto the sheet 2 (secondary transfer).

The cleaning device 15 removes toner and other subjects (including dirt) remaining adhering to the circumferential surface of the photoreceptor drum 11 after the primary transfer. In this way, preparation for next image forming processing is made.

The secondary transfer roller 4 transfers the full-color toner image born on the intermediate transfer belt 3 onto the sheet Z. More specifically, in response to application of a bias to the secondary transfer roller 4, the secondary transfer roller 4 generates electrostatic force in the toner forming the toner image and moves the toner image to the sheet Z using the electrostatic force.

The fixing device 5 includes a heating roller 51 and a pressure roller 52 contacting the heating roller 51 under pressure. The sheet z including the transferred toner image is passed through between the heating roller 51 and the pressure roller 52 to apply appropriate heat and appropriate pressure to the toner image. In this way, the toner image is fixed on the sheet Z.

[2] Structure of Developing Device

Figure 2:
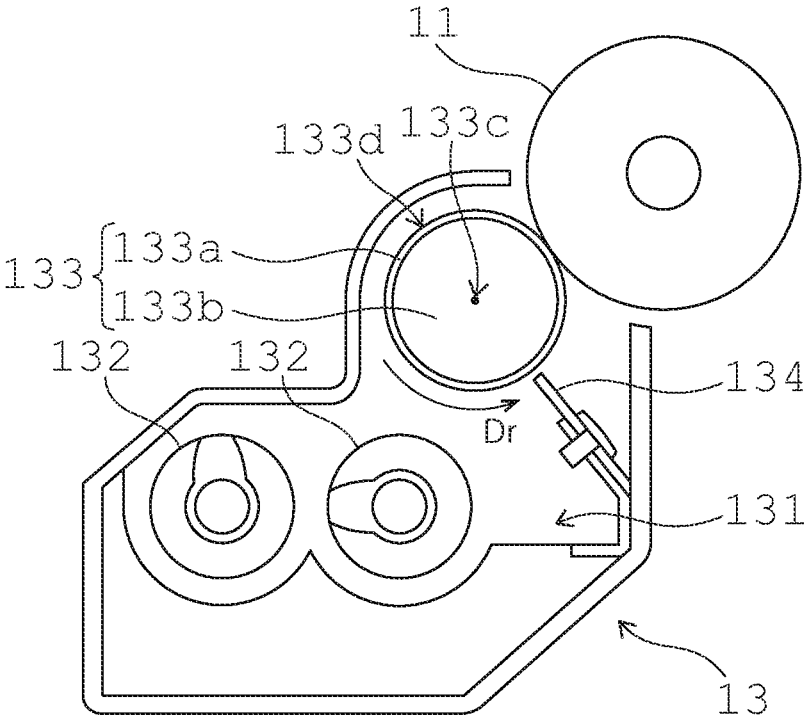
FIG. 2 is a conceptual view showing the developing device in the image forming apparatus.

As shown in FIG. 2, the developing device 13 includes a developer path 131, two stirring screws 132, the developing roller 133, and a regulating portion 134.

<Developer Bath>

Developer is stored in the developer bath 131. The developer used in this embodiment contains nonmagnetic toner and magnetic carrier. It is preferable that low-temperature fixing toner be used as the nonmagnetic toner.

<Stirring Screw>

The stirring screws 132 are used for stirring the developer stored in the developer bath 131. This stir is to generate friction between the nonmagnetic toner and the magnetic carrier in the developer; thereby charging the nonmagnetic toner by the friction.

<Developing Roller>

The developing roller 133 includes a sleeve portion 133*a* and a magnet portion 133*b*. The sleeve portion 133*a* has a cylindrical shape and can rotate around a central axis 133*c*. In this embodiment, the sleeve portion 133*a* rotates in a given rotation direction Dr indicated by an arrow of FIG. 2. The magnet portion 133*b* is arranged inside the sleeve portion 133*a* in such a manner that the circumferential surface of the magnet portion 133*b* faces the inner surface of the sleeve portion 133*a* and is fixed independently of the sleeve portion 133*a*. Thus, the sleeve portion 133*a* is responsible for the rotation of the developing roller 133, so that the central axis 133*c* of the sleeve portion 133*a* forms the central axis of the developing roller 133. A circumferential surface 133*d* of the sleeve portion 133*a* forms the circumferential surface of she developing roller 133.

Figure 3:
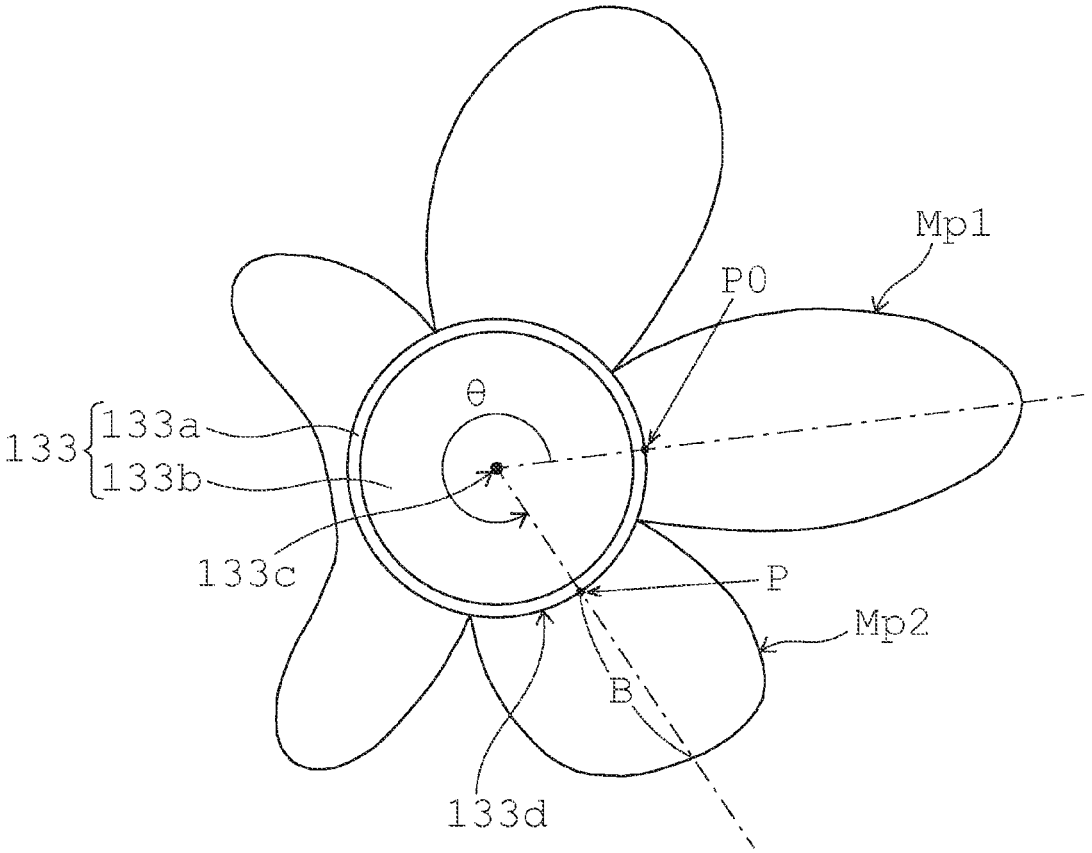
FIG. 3 is a conceptual view showing a plurality of magnetic poles formed on the circumferential surface of a developing roller.

As a result of the magnetic properties of the magnet portion 133*b*, the circumferential surface 133*d* of the sleeve portion 133*a* is given a plurality of magnetic poles each having single polarity. As shown in FIG. 3, these magnetic poles include a main pole Mp1 and a regulating pole Mp2. The circumferential surface of the magnet portion 133*b* may be given cutouts for forming various types of magnetic poles.

Referring to FIG. 3, a curve indicating a magnetic pole shows the magnitude of a magnetic flux density B in a direction normal to the circumferential surface 133*d* of the sleeve portion 133*a* (this magnetic flux density B will hereinafter be called a "magnetic flux density B" simply). More specifically, an angle θ in a left-handed (anticlockwise) direction from a position P0 at the main pole Mp1 is determined in a position P on the circumferential surface 133*d*. The curve shows how the magnitude of the magnetic flux density B changes with respect to the angle θ. This also applies to the curves of FIGS. 4A and 4B.

The main pole Mp1 is a magnetic pole that prevents the magnetic carrier from coming off the circumferential surface 133*d* during development. The main pole Mp1 is formed in a region covering a developing position (a position facing the photoreceptor drum 11) on the circumferential surface 133*d* of the sleeve portion 133*e*.

Figure 4A:
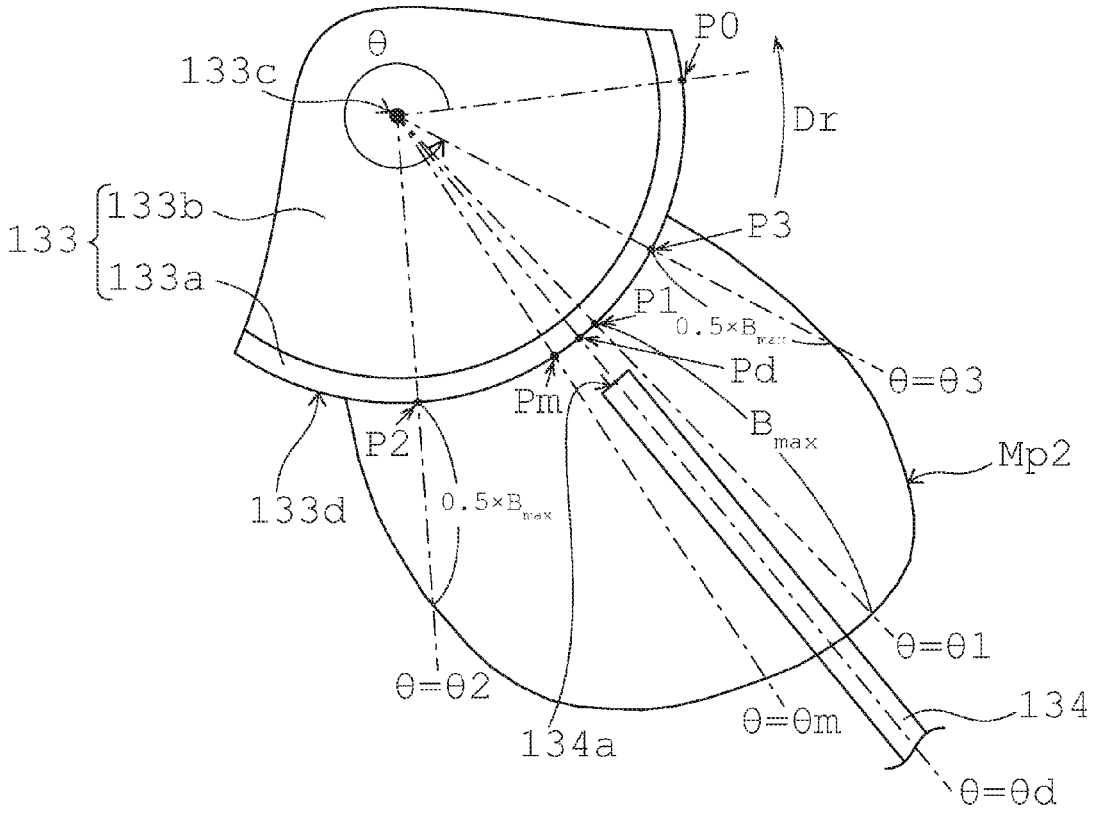
FIG. 4A shows the structure of a regulating pole and that of a regulating portion in detail.
Figure 4B:
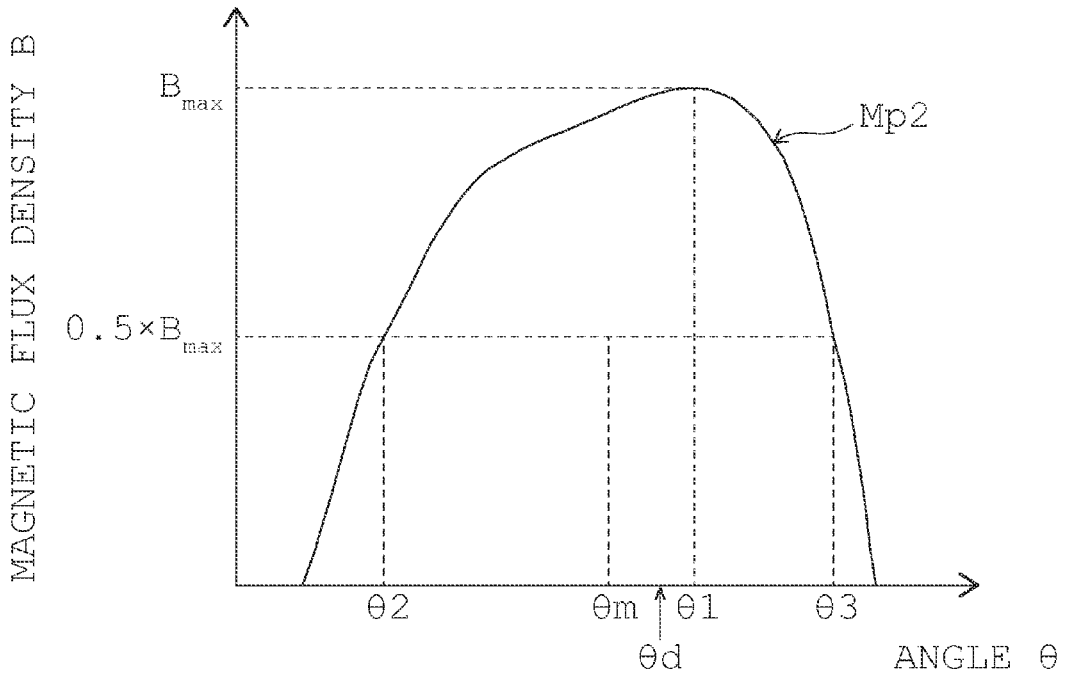
FIG. 4B shows a magnetic flux density B in a normal direction at the regulating pole.

The regulating pole Mp2 is a magnetic pole facing the regulating portion 134 described later. More specifically, as shown in FIGS. 4A and 4B, at the regulating pole Mp2, the magnetic flux density B on the circumferential surface 133*d* of the sleeve portion 133*a* takes a maximum $B_{max}$ in a first position P1 (θ=θ1) on the circumferential surface 133*d* in the rotation direction Dr, and takes a value half of the maximum $B_{max}$ in a second position P2 (θ=θ2) and a third position P3 (θ=θ3) on the circumferential surface 133*d* in the rotation direction Dr. The first position P1 is shifted downstream from an intermediate position Pm (θ=θm) between the second and third positions P2 and P3.

The regulating pole Mp2 further functions as a lifting pole that lifts the developer stored in the developer bath 131. The lifted developer is fed to the developing position in response to the rotation of the sleeve portion 133*a* while adhering to the circumferential surface 133*d* of the sleeve portion 133*a*.

The circumferential surface 133*d* of the sleeve portion 133*a* is given roughness in order for the lifted developer of a proper amount to adhere to the circumferential surface 133*d*. This roughness causes a risk of the occurrence of image quality deficiency (such as nonuniform image quality) in a resultant image. Such image quality deficiency becomes more apparent with increase in a maximum β of a height difference of the roughness. Meanwhile, by setting the maximum $B_{max}$ of the magnetic flux density B at the regulating pole Mp2 properly in terms of a relationship with the maximum β, image quality deficiency can be suppressed, as will hereinafter be described in detail.

<Regulating Portion>

The regulating portion 134 regulates the amount of feed of the developer in a position upstream from the developing position (that faces the photoreceptor drum 11 and corresponds to the position PO or its neighboring position) in the rotation direction Dr and adjacent to the circumferential surface 133*d* of the sleeve portion 133*a* of the developing roller 133. More specifically, the regulating portion 134 is a doctor blade and forms a gap with the circumferential surface 133*d* of the sleeve portion 133*a* in the position upstream from one developing position. The regulating portion 134 regulates the amount of passage of the developer using the gap, thereby regulating the amount of feed of the developer. The regulating portion 134 is not limited to a doctor blade. Various types of tools usable for regulating the amount of feed of the developer are applicable as the regulating portion 134.

As shown in FIG. 4A, the regulating portion 134 is arranged in such a manner that a tip portion 134*a* of the regulating portion 134 faces a position Pd (θ=θd) between the first position P1 and the intermediate position Pm. Alternatively, the regulating portion 134 may be arranged in such a manner that the tip portion 134*a* faces the first position P1.

In the developing device 13 of this embodiment, magnetic force is generated in the magnetic carrier in the developer stored in the developer bath 131 by the action of the regulating pole Mp2 and this magnetic force acts to make the magnetic carrier bring the nonmagnetic toner and adhere to the circumferential surface 133*d* of the sleeve portion 133*a* together with the nonmagnetic toner. In this way, the developer is lifted from the developer bath 131 in a place upstream from the regulating portion 134. In response to the rotation of the sleeve portion 133*a,* the amount of feed of the lifted developer is regulated by the regulating portion 134 and then the developer is fed to the developing position.

In the developing device 13 of this embodiment, the first position P1 (position where the magnetic flux density B takes a maximum) is shifted downstream from the intermediate position Pm. Further, the tip portion 134*a* of the regulating portion 134 faces the position Pd between the first position P1 and the intermediate position Pm or faces the first position P1. Thus, the magnetic flux density B is reduced in a place upstream from the regulating portion 134, whereas a range of distribution of the regulating pole Mp2 is increased in a place upstream from the position facing the tip portion 134*a* of the regulating portion 134. As a result, while the magnetic flux density B is low in a place upstream from the regulating portion 134, the developer of an amount sufficient for development can be lifted from the developer bath 131 in a place upstream from the regulating portion 134.

The low magnetic flux density B in a place upstream from the regulating portion 134 reduces the amount of adhesion of the developer per unit area. This reduces the amount of the developer that the regulating portion 134 removes by the unit rotation amount of the sleeve portion 133*a*. Further, the regulating portion 134 is arranged to face the first position P1 (position where the magnetic flux density B takes a maximum) or a position upstream from the first position P1. Thus, the developer permitted to pass through by the regulating portion 134 can move downstream from the regulating portion 134 easily on receipt of the action of the magnetic flux density B in the first position P1. In this way, the probability or stress on the developer is reduced, so that a torque required for the rotation of the sleeve portion 133*a* is reduced.

To achieve lifting of the developer of a proper amount and reduce a torque required for the rotation of the sleeve portion 133*a,* it is preferable that elements mentioned in the following items (1) to (4) be set at proper values. The proper values of the elements in the items (1) to (4) will be described in detail later.

(1) An open angle (θ3-θ2) between the second and third positions P2 and P3 around the central axis 133*c;*

(2) An open angle (θ1-θm) between the first position P1 and the intermediate position Pm around the central axis 133*c;*

(3) The angle θd in a left-handed direction in the position Pd with respect to the position P0; and (4) A ratio $B_{max}/B_0$ between the maximum $B_{max}$ of the magnetic flux density B at the regulating pole Mp2 and a maximum B0 of the magnetic flux density B at the main pole Mp1.

The developing device 13 of this embodiment can reduce a torque required for the rotation of the sleeve portion 133*a,* so that it is used preferably, particularly if the nonmagnetic toner in the developer to be used is likely to require a large torque. The toner likely to require a large torque is low-temperature fixing toner, for example.

[3] Examples

Examples of the developing device 13 will be described below by mainly giving specific exemplary structures of the regulating pole Mp2 and those of the regulating portion 134.

[3-1] Working Example 1

As shown in Table 1 given below, according to Working Example 1, the magnet portion 133*b* was magnetized in such a manner as to form the following magnetic poles. Specifically, the maximum B0 of the magnetic flux density B at the main pole Mp1 was set at 110 mT. Regarding the regulating pole Mp2, the maximum $B_{max}$ of the magnetic flux density B was set at 54 mT, the open angle (θ3-θ2) at 60°, the angle θm at 275°, the angle θ1 at 285°, and the angle θd at 280°. Table 1 contains data obtained, by the present inventors.

TABLE 1

| | B0 (mT) | $B_{max}$ (mT) | $B_{max}$/B0 (%) | θ3 − θ2 (°) | θm (°) | θ1 (°) | θ1 − θm (°) | θd (°) | T (gf) | Image quality deficiency |
|---|---|---|---|---|---|---|---|---|---|---|
| Working Example 1 | 110 | 54 | 49.1 | 60 | 275 | 285 | 10 | 280 | 900 (○) | No (○) |
| Comparative Example 1 | 110 | 54 | 49.1 | 40 | 275 | 275 | 0 | 275 | 900 (○) | Yes (x) |
| Comparative Example 2 | 110 | 54 | 49.1 | 90 | 275 | 285 | 10 | 280 | 1100 (x) | No (○) |

According to Working Example 1, a torque T required for the rotation of the sleeve portion 133*a* was 900 gf and no image quality deficiency was caused in a printed image. The torque T is preferably 1000 gf or less. Working Example 1 achieves the torque T of such a value. The torque T of a preferable value and a favorable image quality are considered having been achieved for the reason that the elements in the items (1) to (4) were set at proper values. In the column of the torque T in Table 1, the torque T not exceeding 1000 gf is identified by a sign o, whereas the torque T exceeding 1000 gf is identified by a sign x. In the column of the image quality deficiency in Table 1, an image quality without deficiency is identified by a sign o, whereas an image quality with deficiency is identified by a sign x.

The open angle (θ3-θ2) corresponding to the element in the item (1) is examined first by comparing data about Working Example 1 and data about each of Comparative Examples 1 and 2. As shown in Table 1, the open angle (θ3-θ2) was set at 60° according to Working Example 1, whereas it was set at 40° ands 90° according to Comparative Examples 1 and 2 respectively.

According to Comparative Example 1, the torque T was substantially the same as that of Working Example 1. However, image quality deficiency was caused. This is considered being for the reason that the small open angle (θ3-θ2) made it difficult to lift developer of a proper amount. According to Comparative Example 2, a favorable image quality was achieved. However, the torque T exceeded 1000 gf. This is considered being for the reason that, as a res alt of the large open angle (θ3-θ2), developer was lifted excessively to involve the large torque T.

Thus, it is preferable that the open angle (θ3-θ2) be set in a range covering 60°, with an upper limit being smaller than 90° and a lower limit being larger than 40°. The open angle (θ3-θ2) (=40°) according to Comparative Example 1 is substantially the same as a corresponding open angle at the main pole Mp1. Thus, it is preferable that the open angle (θ3-θ2) be larger than the corresponding open angle at the main pole Mp1.

[3-2] Working Example 2

As shown in Table 2 given below, according to Working Example 2, the magnet portion 133*b* was magnetized in such a manner as to set the angle θ1 at 280°. According to Working Example 2, the position of the regulating portion 134 was changed in such a manner as to set the angle θd at 278°. More specifically, the maximum B0 of the magnetic flux density B at the main pole Mp1 was set at 110 mT. Regarding the regulating pole Mp2, the maximum $B_{max}$ of the magnetic flux density B was set at 54 mT, the open angle (θ3-θ2) at 60°, the angle θm at 275°, the angle θ1 at 280°, and the angle θd at 278°. Table 2 contains data obtained by the present inventors.

According to Working Example 2, the torque T required for the rotation of the sleeve portion 133*a* was 900 gf, which is the same value obtained in Working Example 1. Further, no image quality deficiency was caused in a printed image. This is assumed to mean that the shift of the first position P1 (θ=θ1) from the intermediate position Pm (θ=θm) is important.

Then, the open angle (θ1-θm) corresponding to the element in the item (2) is examined by comparing data about each of Working Examples 1 and 2 and data about each of Comparative Examples 3 and 4. As shown in Table 2, the open angle (θ1-θm) was set at 10° and 5° according to Working Examples 1 and 2 respectively, whereas it was set at 0° and −10° according to Comparative Examples 3 and 4 respectively.

According to each of Comparative Examples 3 and 4, while a favorable image quality was achieved, the torque T exceeded 1000 gf. This is considered being for the reason that, by arranging the first position P1 where the magnetic flux density B takes a maximum in the intermediate position Pm or a position upstream from the intermediate position Pm, the magnetic flux density B was increased in a place upstream from the regulating portion 134, so that developer was lifted excessively.

Thus, the open angle (θ1-θm) is preferably larger than 0°, more preferably, 5° or more.

[3-3] Working Example 3

As shown in Table 3 given below, according to Working Example 3, the position of the regulating portion 134 was changed in such a manner as to set the angle θd at 285°. In other words, the tip portion 134*a* of the regulating portion 134 was arranged to face the first position P1 where the magnetic flux density B takes a maximum. More specifically, the maximum B0 of the magnetic flux density B at the main pole Mp1 was set at 110 mT. Regarding the regulating pole Mp2, the maximum $B_{max}$ of the magnetic flux density B was set at 54 mT, the open angle (θ3-θ2) at 60°, the angle θm at 275°, the angle θ1 at 285°, and the angle θd at 285°. Table 3 contains data obtained by the present inventors.

TABLE 2

| | B0 (mT) | $B_{max}$ (mT) | $B_{max}$/B0 (%) | θ3 − θ2 (°) | θm (°) | θ1 (°) | θ1 − θm (°) | θd (°) | T (gf) | Image quality deficiency |
|---|---|---|---|---|---|---|---|---|---|---|
| Working Example 1 | 110 | 54 | 49.1 | 60 | 275 | 285 | 10 | 280 | 900 (○) | No (○) |
| Working Example 2 | 110 | 54 | 49.1 | 60 | 275 | 280 | 5 | 278 | 900 (○) | No (○) |
| Comparative Example 3 | 110 | 54 | 49.1 | 60 | 275 | 275 | 0 | 275 | 1200 (x) | No (○) |
| Comparative Example 4 | 110 | 54 | 49.1 | 60 | 275 | 265 | −10 | 275 | 1300 (x) | No (○) |

TABLE 3

| | B0 (mT) | $B_{max}$ (mT) | $B_{max}$/B0 (%) | θ3 − θ2 (°) | θm (°) | θ1 (°) | θ1 − θm (°) | θd (°) | T (gf) | Image quality deficiency |
|---|---|---|---|---|---|---|---|---|---|---|
| Working Example 1 | 110 | 54 | 49.1 | 60 | 275 | 285 | 10 | 280 | 900 (○) | No (○) |
| Working Example 3 | 110 | 54 | 49.1 | 60 | 275 | 285 | 10 | 285 | 1000 (○) | No (○) |
| Comparative Example 5 | 110 | 54 | 49.1 | 60 | 275 | 285 | 10 | 275 | 800 (○) | Yes (x) |
| Comparative Example 6 | 110 | 54 | 49.1 | 60 | 275 | 285 | 10 | 265 | 900 (○) | Yes (x) |
| Comparative Example 7 | 110 | 54 | 49.1 | 60 | 275 | 285 | 10 | 290 | 1000 (x) | Yes (x) |

According to Working Example 3, the torque T required for the rotation of the sleeve portion 133*a* was 1000 gf. Further, no image quality deficiency was caused in a printed image. This is assumed to mean that the position of the regulating portion 134 can be changed (specifically, the angle θd can be changed).

Then, the angle θd corresponding to the element in the item (3) is examined by comparing data about each of Working Examples 1 and 3 and data about each of Comparative Examples 5 to 7. As shown in Table 3, the angle θd was set at 280° and 285° according to Working Examples 1 and 3 respectively, whereas it was set at 275°, 265°, and 290° according to Comparative Examples 5 to 7 respectively. Specifically, according to Comparative Example 5, the tip portion 134*a* of the regulating portion 134 was arranged to face the intermediate position Pm. According to Comparative Example 6, the tip portion 134*a* of the regulating portion 134 was arranged to race a position upstream from the intermediate position Pm. According to Comparative Example 7, the tip portion 134*a* of the regulating portion 134 was arranged to face a positron downstream from the first position P1.

According to each of Comparative Examples 5 and 6, the torque T was substantially the same as that of Working Example 1. However, image quality deficiency was caused. This is considered being for the reason that, by arranging the regulating portion 134 in a position facing the intermediate position Pm or facing a position upstream from the intermediate position Pm, a range of distribution of the regulating pole Mp2 was reduced in a place upstream from the regulating portion 134, so that it was difficult to lift the developer of a proper amount. According to Comparative Example 7, a favorable image quality was achieved. However, the torque T exceeded 1000 gf. This is considered being for the reason that, by arranging the regulating portion 134 in a position downstream from a positron facing the first position P1, a range of distribution of the regulating pole Mp2 was increased excessively in a place upstream from the regulating portion 134, so that developer was lifted excessively to involve the large torque T.

Thus, it is preferable that the angle θd range from a value larger than the angle θm to the angle θ1 or less. Specifically, it is preferable that the tip portion 134*a* of the regulating portion 134 face a position between the first position P1 and the intermediate position Pm or face the first position P1.

[3-4] Working Example 4

As shows in Table 4 given below, according to Working Example 4, the ratio $B_{max}$/B0 was changed to 40%. More specifically, the maximum B0 of the magnetic flux density B at the main pole Mp1 was set at 135 mT. Regarding the regulating pole Mp2, the maximum $B_{max}$ of the magnetic flux density B was set at 54 mT, the open angle (θ3-θ2) at 60°, the angle θm at 275°, the angle θ1 at 285°, and the angle θd at 280°. Table 4 contains data obtained by the present inventors.

TABLE 4

| | B0 (mT) | $B_{max}$ (mT) | $B_{max}$/B0 (%) | θ3 − θ2 (°) | θm (°) | θ1 (°) | θ1 − θm (°) | θd (°) | T (gf) | Image quality deficiency |
|---|---|---|---|---|---|---|---|---|---|---|
| Working Example 1 | 110 | 54 | 49.1 | 60 | 275 | 285 | 10 | 280 | 900 (○) | No (○) |
| Working Example 4 | 135 | 54 | 40 | 60 | 275 | 285 | 10 | 280 | 900 (○) | No (○) |
| Comparative Example 8 | 110 | 70 | 63.6 | 40 | 275 | 275 | 0 | 275 | 1400 (x) | No (○) |
| Comparative Example 9 | 110 | 40 | 36.4 | 60 | 275 | 285 | 10 | 280 | 800 (○) | Yes (x) |
| Comparative Example 10 | 110 | 60 | 54.5 | 60 | 275 | 285 | 10 | 280 | 1200 (x) | No (○) |

According to Working Example 4, the torque T required for the rotation of the sleeve portion 133*a* was 900 gf, which is the same value obtained in Working Example 1. Further, no image quality deficiency was caused in a printed image. This is assumed to mean that the ratio $B_{max}$/B0 can be changed.

Then, the ratio $B_{max}$/B0 corresponding to the element in the item (4) is examined by comparing data about each of Working Examples 1 and 4 and data about each of Comparative Examples 8 to 10. As shown in Table 4, the ratio $B_{max}$/B0 was set at 49.1% and 40% according to Working Examples 1 and 4 respectively, whereas it was set at 63.6%, 36.4%, and 54.5% according to Comparative Examples 8 to 10 respectively.

According to Comparative Example 9, the torque T was substantially the same as that of Working Example 1. However, image quality deficiency was caused. This is considered being tor the reason that reducing the ratio $B_{max}$/B0 excessively made it difficult to lift developer of a proper amount. According to each of Comparative Examples 8 and 10, a favorable image quality was achieved. However, the torque T exceeded 1000 gf. This is considered being for the reason that, as the ratio $B_{max}$/B0 was increased excessively, developer was lifted excessively to involve the large torque T.

Thus, it is preferable that the ratio $B_{max}$/B0 range from 40% or more to 50% or less.

[3-5] Working Example 5

As shown in Table 5 given below, according to Working Example 1, roughness having a height difference at the maximum β of 10 μm was formed on the circumferential surface 133*d* of the sleeve portion 133*a*. According to each of Working Examples 5 to 7, roughness was formed on the circumferential surface 133*d* of the sleeve portion 133*a* and the maximum β of a height difference of this roughness was set at 50 μm, 60 μm, and 70 μm according to Working Examples 5 to 7 respectively. Additionally, according to each of Working Examples 5 to 7, the magnet portion 133*b* was magnetized in such a manner as to set the maximum $B_{max}$ of the magnetic flux density B at the regulating pole Mp2 at 40 mT. The other conditions employed by each of Working Examples 5 to 7 were the same as those employed by Working Example 1. Table 5 contains data obtained by the present inventors.

According to Comparative Example 11, roughness having a height difference at the maximum β of 100 μm was formed on the circumferential surface 133*d* of the sleeve portion 133*a*. The other conditions employed by Comparative Example 11 were the same as those employed by each of Working Examples 3 to 7. According to Comparative Example 12, roughness having a height difference at the maximum β of 5 μm was formed on the circumferential surface 133*d* of the sleeve portion 133*a*. The other conditions employed by Comparative Example 12 were the same as those employed by Working Example 1.

TABLE 5

| | B0 (mT) | $B_{max}$ (mT) | $B_{max}$/B0 (%) | Zr | (3/2) × Zr | β (μm) | T (gf) | Image quality deficiency |
|---|---|---|---|---|---|---|---|---|
| Working Example 1 | 110 | 54 | 49.1 | 34.3 | 51.4 | 10 | 900 (○) | No (○) |
| Working Example 5 | 110 | 40 | 36.4 | 62.5 | 93.8 | 50 | 800 (○) | No (○) |
| Working Example 6 | 110 | 40 | 36.4 | 62.5 | 93.8 | 60 | 800 (○) | No (○) |
| Working Example 7 | 110 | 40 | 36.4 | 62.5 | 93.8 | 70 | 800 (○) | No (○) |
| Comparative Example 11 | 110 | 40 | 36.4 | 62.5 | 93.8 | 100 | 800 (○) | Yes (x) |
| Comparative Example 12 | 110 | 54 | 49.1 | 34.3 | 51.4 | 5 | 900 (○) | Yes (x) |

According to each of Working Examples 5 to 7, the torque T required for the rotation of the sleeve portion 133*a* was 800 gf and no image quality deficiency was caused in a printed image. According to Comparative Example 11, the torque T was substantially the same as that of Working Example 1. However, image quality deficiency was caused. Based on these results, the present inventors derived the following relationship between the maximum $B_{max}$ of the magnetic flux density B at the regulating pole Mp2 and the maximum β of a height difference of roughness. Like in Comparative Example 11, according to Comparative Example 12, image quality deficiency was caused. However, this reason is considered being different from the reason of Comparative Example 11. Specifically, the image quality deficiency was caused in Comparative Example 12 for the reason that, as the maximum β of a height difference was too small,, developer of a proper amount did not adhere to the circumferential surface 133*d* of the sleeve portion 133*a*.

The present inventors found that a physical amount Zr, defined as $Zr=B_{max}^{-2}\times10^5$, is important for deriving the relationship with the maximum β of a height difference. Then, the present inventors compared a value, obtained by multiplying the physical amount Zr by 3/2, with the maximum β of a height difference (see Table 5). As a result, the present inventors found that, with a value expressed as (3/2)×Zr being larger than the maximum β of a height difference, image quality deficiency resulting from roughness is suppressed. Specifically, the present inventors found that it is preferable that the magnetic flux density B at the regulating pole Mp2 be adjusted in response to a height difference of roughness in such a manner as to make the physical amount Zr itself larger than a value obtained by multiplying the maximum β of a height difference by 2/3.

The present inventors further found that Working Example 7 caused a problem regarding the durability of the developing roller 133. Based on this finding, the present inventors found that it is more preferable that the magnetic flux density B at the regulating pole Mp2 be adjusted in such a manner as to make the physical amount Zr itself larger than the maximum β of a height difference.

[4] Other Embodiments

A color multifunction machine is employed as an example of the aforementioned image forming apparatus. However, every constituent structure including the developing device 13 is applicable not only to a color multifunction machine but also to various types of image forming apparatuses such as a color copier and a color printer. Additionally, every constituent structure including the developing device 13 is applicable not only to an image forming apparatus intended to produce color images but also to an image forming apparatus intended to produce monochrome images.

It should be noted that the foregoing description of the embodiment is in all aspects illustrative and not restrictive. The scope of this invention is defined by the appended claims rather than by the embodiment described above. All changes that fall within a meaning and a range equivalent to the scope of the claims are therefore intended to be embraced by the claims.

What is claimed is:

1. A developing device comprising;

a developing roller that rotates in a given rotation direction to feed developer containing nonmagnetic toner and magnetic carrier to a developing position, the developing roller including a circumferential surface on which a regulating pole having single polarity is formed; and a regulating portion that regulates the amount of feed of the developer in a position upstream from the developing position in the rotation direction and adjacent to the circumferential surface of the developing roller, wherein at the regulating pole, a magnetic flux density in a direction normal to the circumferential surface of the developing roller takes a maximum in a first position on the circumferential surface in the rotation direction and takes a value half of the maximum in a second position and a third position on the circumferential surface in the rotation direction, the first position being shifted downstream from an intermediate position between the second the third positions, and a tip portion of the regulating portion faces a position between the first position and the intermediate position or faces the first position.

2. The developing device according to claim 1, wherein an open angle between the first position and the intermediate position around a rotation axis of the developing roller in 5° or more.

3. The developing device according to claim 2, wherein a main pole that prevents the magnetic carrier from coming off the circumferential surface of the developing roller is formed in a region covering the developing position on the circumferential surface, and the maximum of the magnetic flux density at the regulating pole is from 40% or more to 50% or less of a maximum of the magnetic flux density at the main pole.

4. The developing device according to claim 3, wherein an open angle between the second and third positions around the rotation axis is larger than a corresponding open angle at the main pole.

5. The developing device according to claim 2, wherein a main pole that prevents the magnetic carrier from coming off the circumferential surface of the developing roller is formed in a region covering the developing position on the circumferential surface, and an open angle between the second and third positions around the rotation axis is larger than a corresponding open angle at the main pole.

6. The developing device according to claim 1, wherein a main pole that prevents the magnetic carrier from coming off the circumferential surface of the developing roller is formed in a region covering the developing position on the circumferential surface, and the maximum of the magnetic flux density at the regulating pole is from 40% or more to 50% or less of a maximum of the magnetic flux density at the main pole.

7. The developing device according to claim 6, wherein an open angle between the second and third positions around a rotation axis of the developing roller is larger than a corresponding open angle at the main pole.

8. The developing device according to claim 1, wherein a main pole that prevents the magnetic carrier from coming off the circumferential surface of the developing roller is formed in a region covering the developing position on the circumferential surface, and an open angle between the second and third positions around a rotation axis of the developing roller is larger than a corresponding open angle at the main pole.

9. The developing device according to claim 1, wherein the nonmagnetic toner in the developer is low-temperature fixing toner.

10. The developing device according to claim 1, wherein a physical amount, obtained by multiplying the square of the reciprocal of the maximum (unit: mT) at the regulating pole by $10^5$, is larger than a value obtained by multiplying a maximum (unit: μm) of a height difference of roughness formed on the circumferential surface of the developing roller by 2/3.

* * * * *